US005400855A

United States Patent [19]

Stepp et al.

[11] Patent Number: 5,400,855

[45] Date of Patent: Mar. 28, 1995

[54] CASING INFLATION PACKER

[75] Inventors: Lee W. Stepp, Comanche; Eugene E. Baker, Duncan; Richard L. Giroux, Duncan; John T. Brandell, Duncan, all of Okla.

[73] Assignee: Halliburton Company, Duncan, Okla.

[21] Appl. No.: 10,225

[22] Filed: Jan. 27, 1993

[51] Int. Cl.[6] ..... E21B 33/127

[52] U.S. Cl. ..... 166/151; 166/187; 166/188

[58] Field of Search ..... 166/122, 133, 151, 187, 166/188, 387

[56] References Cited

U.S. PATENT DOCUMENTS

| | | | |
|---|---|---|---|
| 3,811,500 | 5/1974 | Morrisett et al. | 166/154 |
| 3,948,322 | 4/1976 | Baker | 166/289 |
| 4,191,383 | 3/1980 | Baker et al. | 277/1 |
| 4,253,676 | 3/1981 | Baker et al. | 277/34.6 |
| 4,310,161 | 1/1982 | Streich | 277/34 |
| 4,372,562 | 2/1983 | Carter, Jr. | 277/34 |
| 4,421,165 | 12/1983 | Szarka | 166/151 |
| 4,934,460 | 6/1990 | Coronado | 166/187 X |
| 5,058,673 | 10/1991 | Muller et al. | 166/187 |
| 5,109,925 | 5/1992 | Stepp et al. | 166/184 |

*Primary Examiner*—Roger J. Schoeppel
*Attorney, Agent, or Firm*—Robert A. Kent; Neal R. Kennedy

[57] ABSTRACT

A casing inflation packer for use in a casing string in a well bore. The apparatus includes a housing connected in the casing string. An inflatable packer portion on the housing sealingly engages the well bore when inflated. An inflation passageway is defined between a housing central opening and the packer. A rupture disc is initially disposed between the central opening and the inflation passageway for preventing communication therebetween. The rupture disc ruptures in response to a first predetermined pressure, thereby placing the central opening in communication with the packer through the inflation passageway. A slidable control valve is disposed in the inflation passageway and is initially shearably held in an open position. Upon application of a second predetermined pressure across the valve, the valve is moved to a closed position, thus preventing overinflation of the packer and also preventing deflation thereof. A check valve allows fluid to enter the packer and acts as a backup preventing fluid from leaving the packer in the event of failure of the control valve. Another check valve provides pressure equalization between the packer and the well annulus as the apparatus is lowered into the well bore. The packer has an elastomeric packer element and metal reinforcing, such as a metal packer bladder, disposed inside the packer element.

23 Claims, 2 Drawing Sheets

CASING INFLATION PACKER

BACKGROUND OF THE INVENTION

1. Field of the Invention

This invention relates to inflation packers used in downhole casing, and more particularly, to a casing inflation packer with a rupture disc for opening in response to a predetermined pressure and allowing inflation of the packer, a pressure actuated valve for closing in response to a second predetermined pressure so that the packer is not overinflated, and a metal bladder within the packer element for support thereof.

2. Description Of The Prior Art

In preparing oil well bore holes for oil and/or gas production, an important step involves the process of cementing. Basically, oil well cementing is the process of mixing a cement-water slurry and pumping it down through steel casing to critical points located in the annulus around the casing, in the open hole below, or in fractured formations.

Cementing a well protects possible production zones behind the casing against salt water flow and protects the casing against corrosion from subsurface mineral waters and electrolysis from outside. Cementing also eliminates the danger of fresh drinking water and recreational water supply strata being contaminated by oil or salt water flow through the bore hole from formations containing these substances. It further prevents oil well blowouts and fires caused by high pressure gas zones behind the casing and prevents collapse of the casing from high external pressures which can build up underground.

A cementing operation for protection against the above-described downhole condition is called primary cementing, and the present invention is generally useful in such cementing.

One prior art type of casing inflation packer utilizes a knock-off pin and initial control valve. The initial control valve contains relatively small O-rings requiring difficult manufacturing techniques. Also, these O-rings may be inadvertently cut when the packer is installed and possibly during downhole operations.

The knock-off pin of the prior art packer protrudes into the inside diameter of the valve body. The knock-off pin is sheared by pumping a plug downwardly thereto or by manipulation of a work string in the casing. In some cases, the knock-off pin has prevented the plug being pumped from seating properly.

The present invention solves these problems by using a rupture disc which prevents the packer from being inflated until a first predetermined pressure is attained inside the casing. A shearably attached initial control valve is disposed between the rupture disc and the inflatable packer and is designed to close in response to a second predetermined pressure so that the packer is not overinflated. Once closed, the control valve locks in the closed position, thereby preventing the packer from deflating. A secondary back pressure valve with an elastomeric lip acting as a check valve keeps the packer inflated should the control valve fail. The same type of check valve is used at the other end of the packer to keep pressure equalized inside the packer as the tool is being placed downhole.

SUMMARY OF THE INVENTION

The casing inflation packer of the present invention is adapted for use in a casing string for positioning in a well bore. The invention may be described as an inflatable casing packing apparatus comprising housing means for connecting to the casing string and defining a central opening therethrough, inflatable packing means connected to the housing means for sealingly engaging the well bore when inflated, and rupture means for rupturing in response to a first predetermined pressure and thereby placing the packing means in communication with the central opening. Fluid pumped into the central opening is thus directed through the ruptured rupture means and thereby to the packing means for inflation thereof. The apparatus preferably further comprises pressure actuated control valve means for closing a flow path between the rupture means and the packing means in response to a second predetermined pressure, thereby sealingly separating the rupture means and the packing means. The valve means is shearably held in its open position prior to application of the second predetermined pressure.

The rupture means may be characterized by a rupture disc adapted for rupturing at the first predetermined pressure. The rupture means may further comprise a housing ring disposed around the housing means and a disc retaining means for engaging the housing ring and retaining the rupture disc in the housing. The disc retaining means may be characterized by a disc retainer threadingly engaged with the housing ring.

The apparatus may also comprise back pressure valve means or check valve means between the rupture means and the control valve means for allowing movement of the fluid to the packing means while preventing deflation thereof in the event of failure of the control valve means. The check valve means may be characterized by a check valve with an elastomeric lip.

The apparatus may further comprise pressure equalizing means for equalizing pressure in the packing means with well annulus pressure as the casing string is lowered into the well bore. This pressure equalizing means may be characterized by a port defined in the housing means and additional back pressure valve means or check valve means between the port and the packing means for allowing movement of fluid from the well annulus to the packing means while preventing reverse movement of fluid from the packing means to the well annulus. This check valve means may also be characterized by a check valve with an elastomeric lip.

The apparatus may additionally comprise clamping or wedging means for positioning the packing means on the housing means and preventing movement of the packing means with respect to the housing means during inflation.

The packing means preferably comprises an elastomeric packer element and metal supporting or reinforcing means for supporting and reinforcing the element. This metal support means may be characterized by a metal packer bladder disposed inside the packer element, a plurality of metal slats, or other metal elements.

The control valve means may comprise a sleeve valve slidably disposed adjacent to the packer. The valve preferably has a differential area defined thereon in communication with a well annulus. Inflation pressure acting across this differential area will cause shear pins holding the valve in its open position to be sheared, thereby closing the valve to prevent overinflation of the packer. A locking means, such as a retainer ring, is used to lock the control valve in the closed position so that it cannot be reopened. Thus, deflation of the packer is prevented.

Numerous objects and advantages of the invention will become apparent as the following detailed description of a preferred embodiment is read in,conjunction with the drawings which illustrate such embodiment.

DESCRIPTION OF THE PREFERRED EMBODIMENTS

Figure 1A:
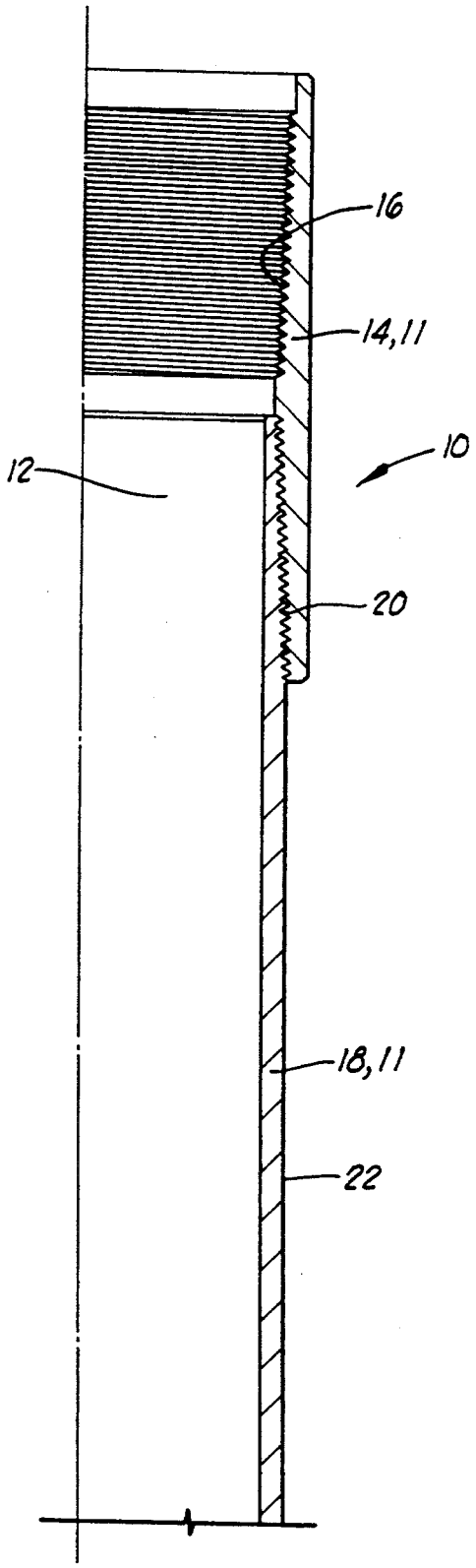
FIGS. 1A-1D illustrate a longitudinal cross section of the casing inflation packer of the present invention.

Referring now to the drawings, the casing inflation packer of the present invention is shown and generally designated by the numeral 10. Packer 10 comprises housing means 11 for connecting to a well casing string and defining a central opening 12 therethrough.

At the top of packer 10, housing means 11 includes an upper adapter 14 having an internally threaded surface 16 therein. See FIG. 1A. Threaded surface 16 is adapted for engagement with an upper portion of a casing string (not shown). The lower end of upper adapter 14 is attached to inner mandrel 18 at threaded connection 20. Inner mandrel 18 also forms a part of housing means 11.

Figure 1B:
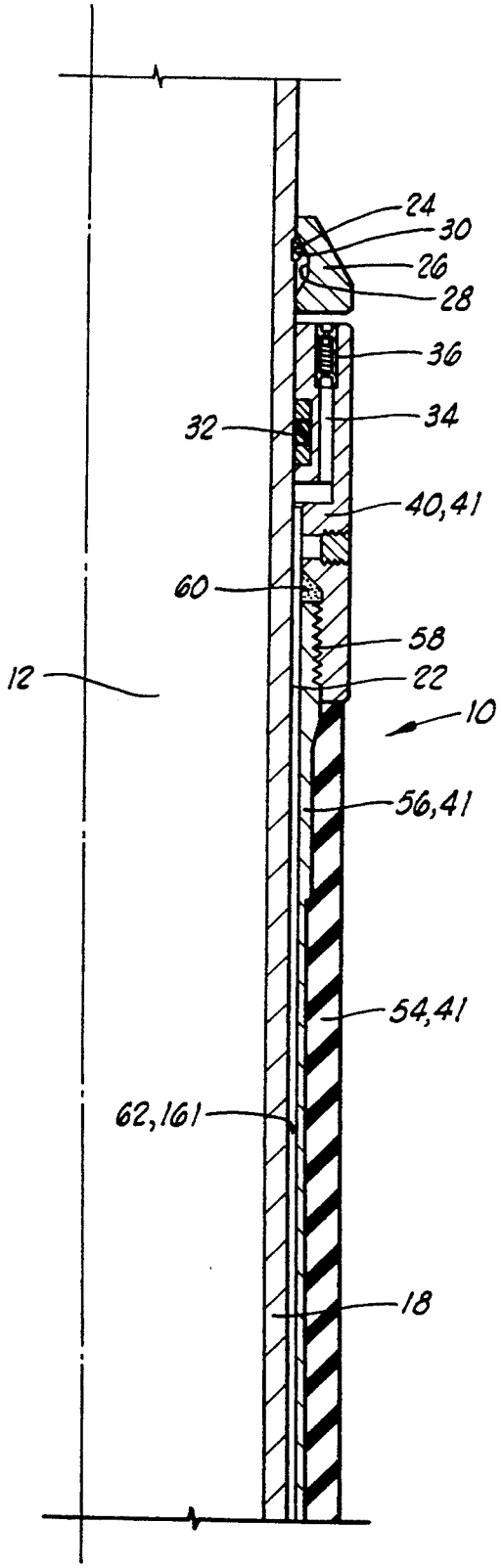

Referring now to FIG. 1B, inner mandrel 18 has an outer surface 22 thereon with a groove 24 defined therein.

An anchor ring 26 is disposed around outer surface 22 of inner mandrel 18 and has a groove 28 defined therein which generally faces groove 24 on the inner mandrel. A split retainer ring 30 is positioned within anchor ring 26 and prevents any substantial longitudinal movement thereof by engagement of the retainer ring with grooves 24 and 28.

Anchor ring 26 and retainer ring 30 combine to anchor themselves to outer surface 22 of inner mandrel 18. This prevents packing means 41 from being prematurely set when picking up casing.

An upper packer shoe 40 of packing means 41 is adjacent to the lower end of anchor ring 26. A sealing means, such as seal 32, provides sealing engagement between upper packer shoe 40 and inner mandrel 18.

A longitudinally disposed port 34 is defined in upper packer shoe 40. A check valve assembly 36 is disposed in the upper end of port 34. Check valve assembly 36 is adapted to allow well annulus fluid to flow into port 34 while preventing fluid flow outwardly from port 34.

Packing means 41 also comprises an elastomeric packer element 54 which is attached to the lower end of upper packer shoe 40 in a manner known in the art. Packing means 41 further comprises a metal packer bladder 56 which is disposed within packer element 54 and connected to upper packer shoe 40 at threaded connection 58. Packer bladder 56 may be further connected to upper packer shoe 40 by other fastening means, such as weld 60.

An inflation annulus 62 is defined between packer bladder 56 and outer surface 22 of inner mandrel 18. It will be seen that inflation annulus 62 is in communication with port 34 in upper packer shoe 40.

Figure 1C:
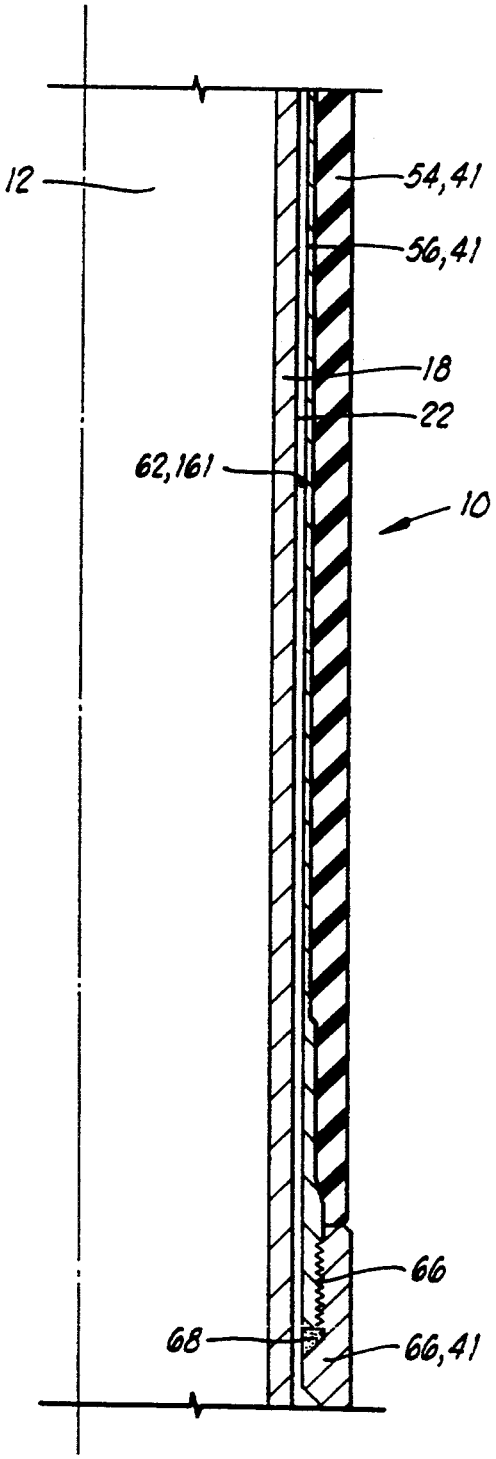

Referring now to FIG. 1C, the lower end of packer element 54 is attached to a lower packer ring 64 in a manner known in the art. Thus, lower packing ring 64 also forms a part of packing means 41. The lower end of packer bladder 56 is connected to lower packer ring 64 at threaded connection 66. Packer bladder 56 may be further affixed to lower packer ring 64 by another fastening means, such as weld 68.

Figure 1D:
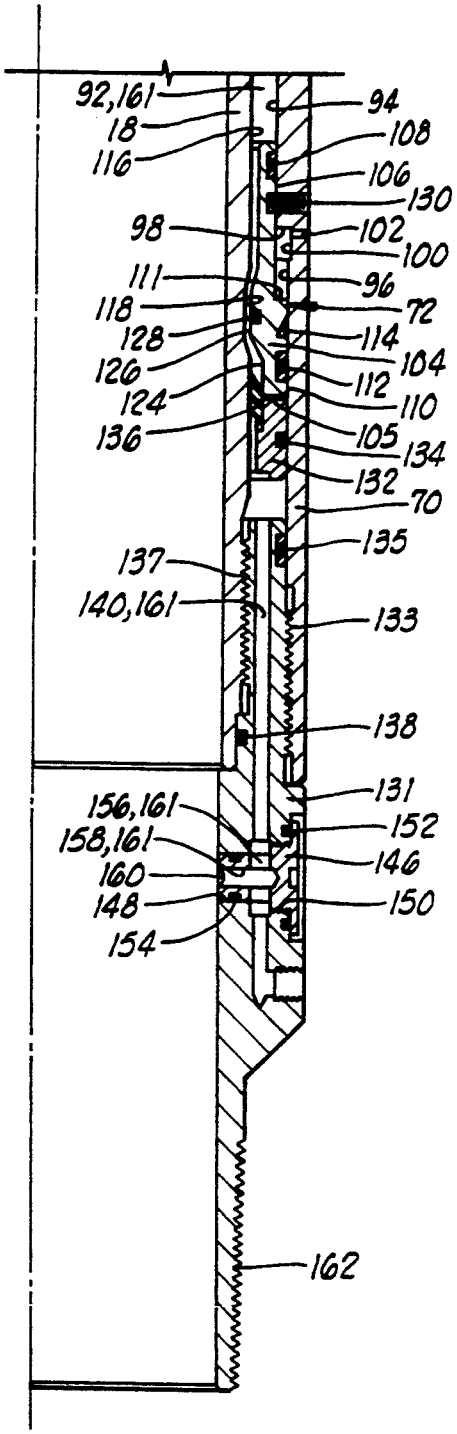

Referring now to FIG. 1D, the lower end of lower packer ring 64 forms a valve case portion 70. Valve case 70 may be said to form a portion of housing means 11, and a control valve means 72 is disposed therein.

An annular volume 92 is defined between the lower portion of valve case 70 and inner mandrel 18. It will be seen that annular volume 92 is in communication with annulus 62 in packing means 41.

Valve case 70 defines a first bore 94 and a somewhat larger second bore 96 below the first bore. A downwardly facing, annular shoulder 98 extends between first bore 94 and second bore 96. A retainer ring groove 100 is defined adjacent to shoulder 98 in second bore 96. Valve case 70 defines a transverse port 102 therethrough which is in communication with a well annulus and opens into retainer ring groove 100.

Control valve means 72 may comprise a sliding sleeve valve 104 slidably disposed within the lower end of valve case 70.

Valve 104 has a lower end 105 and also has a first outer surface 106 thereon which is adapted for sliding within first bore 94 of valve case 70. A sealing means, such as seal 108, provides sliding, sealing engagement between valve 104 and second bore 94. Valve 104 also has a second outer surface 110 thereon which is adapted for sliding within second bore 96 of valve case 70. An upwardly facing annular shoulder 111 extends between first outer surface 106 and second outer surface 110 on valve 104. As will be further seen herein, shoulder 111 defines a differential pressure area on valve 104.

A sealing means, such as seal 112, provides sealing engagement between valve 104 and second bore 96.

Valve sleeve 104 carries a retainer ring 114 thereon which is adapted for locking engagement with retainer ring groove 100, as further described herein.

Inner mandrel 18 has an outer surface 116 thereon. An annular groove 118 is formed in outer surface 116.

Valve 104 defines a bore 124 therein with an annular, radially inwardly raised portion 126 defined thereon. Raised portion 126 carries a sealing means, such as O-ring 128, thereon. O-ring 128 is adapted for sealing engagement with outer surface 116 when valve 104 is actuated to a closed position thereof as further described herein.

Valve 104 is held in the initial, open position shown in FIG. 1D with respect to valve case 70 by a shear means, such as shear pin 130.

Disposed below valve 104 in second bore 96 of valve case 70 is a check valve body 132. A sealing means, such as O-ring 134, provides sealing engagement between check valve body 132 and second bore 96 in valve case 70. An elastomeric check valve or lip 136 is attached to check valve body 132 and adapted for sealing engagement with outer surface 116 of inner mandrel 18.

The lower end of valve case 70 is attached to a lower adapter 131 at threaded connection 133. A sealing means, such as an O-ring 135, provides sealing engagement therebetween. The lower end of inner mandrel 18 is attached to lower adapter 131 at threaded connection 137. A sealing means, such as an O-ring 138, provides sealing engagement between inner mandrel 18 and lower adapter 131.

Lower adapter 131 defines a port 140 therein.

A rupture disc retainer 146 extends transversely through a transverse hole 148 defined in lower adapter 131 and intersects port 140. Rupture disc retainer 146 is preferably attached to lower adapter 131 at threaded connection 150. A sealing means, such as O-ring 152, provides sealing engagement between rupture disc retainer and lower adapter 131. Another sealing means, such as O-ring 154, also provides sealing engagement between rupture disc retainer 146 and lower adapter 131.

Rupture disc retainer 146 defines a port 156 therein which is in communication with port 140 and further defines another port 158 in communication with port 156. Port 158 is initially closed by a rupture disc 160.

As will be further described herein, port 158, port 156, port 140, annular volume 92, and annulus 62 form an inflation passageway means 161 for providing communication between central opening 12 of housing means 11 and packing means 41 for inflation of the packing means after rupturing of rupture disc 160.

The lower end of lower adapter 131 has an externally threaded surface 162 thereon which is adapted for engagement with a lower portion of the casing string (not shown).

Operation Of The Invention

Inflatable packer 10 is made up as part of the casing string which is run into the well bore in a manner known in the art. Packer 10 is in the configuration shown in FIGS. 1A–1D when run into the well bore.

Inflation passageway means 161 is initially filled with a substantially incompressible fluid. As packer 10 is run into the hole, the pressure in the well annulus and the pressure of the incompressible fluid is equalized through check valve 36 and port 34 in upper packer shoe 40. It will be seen that well annulus fluid may pass downwardly past check valve 36, but fluid flow upwardly past the check valve is prevented.

When the casing string is positioned in the location desired and cementing is to be carried out, a tool string (not shown) of a kind known in the art is lowered into the casing. Packer cups on the tool are positioned above and below inflation port 158 and sealingly engaged with the inside of lower adapter 131.

Pressure is then applied to packer 10 through the tool string. When the pressure reaches a first predetermined level, rupture disc 160 will rupture, thereby placing inflation ports 158 in communication with central opening 12 of packer 10. The pressure is thus applied through the inflation port 158, ports 156, port 140 and past lower check valve 136 into annular volume 92. In other words, inflation passageway means 161 is pressurized. It will be seen that fluid flow is allowed upwardly past lower check valve 136 while downward fluid flow is prevented.

Fluid is pumped downwardly through the tool string and thus into annulus 62 to deflect metal bladder 56 radially outwardly and inflate packer element 54, thereby placing packer element 54 into sealing engagement with the well bore.

Because of port 102, well annulus pressure is always on shoulder 111 of valve 104. It will be seen that as pressure is applied to inflate packing means 41, this inflation pressure is applied to lower end 105 of valve 104, thus causing a pressure differential across an area equal to that of shoulder 111. When the pressure reaches a second predetermined level, the differential pressure acting across the area will cause shear pin 130 to be sheared. Valve 104 is thus moved upwardly until shoulder 111 thereon contacts shoulder 98 in valve case 70. At this point, O-ring 128 is brought into sealing engagement with outer surface 116 of inner mandrel 18, thus sealingly separating inflation ports 158 from annulus 62 and thereby stopping the inflation process. Also, as valve 104 moves upwardly, retainer ring 114 snaps outwardly into retainer ring groove 100 in valve case 70 so that valve 104 may not be moved downwardly. Thus, a locking means is provided for locking valve 104 in a closed position, thereby preventing deflation of packing means 41.

In the event of failure of O-ring 128, lower check valve 136 acts as a secondary seal to insure that packing means 41 does not deflate.

It will be seen, therefore, that the casing inflation packer of the present invention is well adapted to carry out the ends and advantages mentioned as well as those inherent therein. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. An inflatable casing packer apparatus for use in a casing string of a well bore, said apparatus comprising:

housing means for connecting to the casing string and defining a central opening therethrough;

inflatable packing means connected to said housing means for sealingly engaging the well bore when inflated; and rupture means for rupturing in response to a predetermined pressure and thereby placing said packing means in communication with said central opening, whereby fluid pumped into said central opening is directed to said packing means for inflation thereof.

2. The apparatus of claim 1 further comprising pressure actuated valve means for closing a flow passageway between said rupture means and said packing means after inflation of said packing means in response to a second predetermined pressure and thereby sealingly separating said rupture means and said packing means.

3. The apparatus of claim 2 wherein:

said valve means comprises a valve sleeve having a differential area defined thereon in communication with the well annulus; and said second predetermined pressure acts across said differential area for actuating said valve means.

4. The apparatus of claim 1 further comprising check valve means between said rupture means and said packing means for allowing movement of fluid to said packing means while preventing deflation thereof.

5. The apparatus of claim 1 wherein said rupture means is characterized by a rupture disc adapted for rupturing at said predetermined pressure.

6. The apparatus of claim 5 wherein said rupture means further comprises a disc retaining means for engaging said housing means and retaining said rupture disc in said housing means.

7. The apparatus of claim 1 further comprising pressure equalizing means for equalizing pressure in said packing means with a well annulus between said casing string and the well bore as said casing string is lowered into the well bore.

8. The apparatus of claim 7 wherein said pressure equalizing means comprises check valve means between said well annulus and said packing means for allowing movement of fluid from said well annulus to said packing means while preventing reverse movement of fluid from said packing means to said well annulus.

9. The apparatus of claim 1 wherein said packing means comprises:

an elastomeric packer element; and metal supporting means for supporting said packer element.

10. The apparatus of claim 9 wherein said metal supporting means is characterized by a metal packer bladder disposed inside said packer element.

11. An inflatable casing packer apparatus for use in a casing string in a well bore, said apparatus comprising:

integral housing means interconnected by a non-movable mandrel having threaded means for connecting to the casing string and defining a central opening therethrough;

inflatable packing means connected to said housing means for sealingly engaging the well bore;

inflation passageway means for providing communication between said packing means and said central opening of said housing means, whereby fluid may be pumped from said housing means to said packing means for inflation thereof; and pressure actuated valve means disposed in said inflation passageway means and physically isolated from said central opening for closing said inflation passageway means after inflation of said packing means and for preventing deflation thereof, said valve means having a shoulder thereon and being actuated only in response to a predetermined differential pressure across said shoulder.

12. The apparatus of claim 11 wherein said valve means is shearably retained in an open position prior to application of said predetermined differential pressure.

13. The apparatus of claim 12 wherein:

said valve means is characterized by a slidable valve sleeve; and further comprising a shear pin for holding said valve sleeve in an open position with respect to said housing means.

14. The apparatus of claim 11 further comprising sealing means on said valve means for sealingly closing said inflation passageway means when said valve means is moved to a closed position.

15. The apparatus of claim 11 further comprising locking means for locking said valve means in a closed position, thereby preventing reopening of said valve means.

16. The apparatus of claim 11 wherein said packing means comprises:

an elastomeric packer element; and metal reinforcing means for reinforcing said packer element.

17. The apparatus of claim 16 wherein said metal reinforcing means is characterized by a metal packer bladder disposed inside said packer element.

18. An inflatable casing packer apparatus for use in a casing string in a well bore, said apparatus comprising:

housing means for connecting to the casing string and defining a central opening therethrough;

inflatable packing means connected to said housing means for sealingly engaging the well bore;

inflation passageway means for providing communication between said packing means and said central opening of said housing means, whereby fluid may be pumped from said housing means to said packing means for inflation thereof;

rupture means between said central opening of said housing means and said inflation passageway means for rupturing in response to a predetermined pressure thereby placing said central opening in communication with said inflation passageway means for inflation of said packing means; and pressure actuated valve means disposed in said inflation passageway means for closing said inflation passageway means after inflation of said packing means and for preventing deflation thereof, said valve means being actuated in response to a predetermined pressure differential thereacross.

19. An inflatable casing packer apparatus for use in a casing string of a well bore, said apparatus comprising:

integral housing means interconnected by a non-movable mandrel having threaded means for connecting to the casing string and defining a central opening therethrough;

inflatable packing means connected to said housing means for sealingly engaging the well bore when inflated, said inflatable packing means comprising:

an elastomeric packer element; and metal reinforcing means for reinforcing said packer element;

inflation passageway means for providing a flow path between said central opening of said housing means and said packing means such that fluid may be pumped into said central opening and directed to said packing means for inflation thereof;

means for opening said inflation passageway means in response to a first differential pressure, thereby allowing inflation of said packing means; and means for closing said inflation passageway means in response to a second predetermined pressure, thereby preventing deflation of said packing means, said means for closing being physically isolated from said central opening and comprising pressure actuated valve means for closing only in response to said second predetermined pressure acting across a shoulder portion of said valve means and thereby sealingly separating said central opening of said housing means and said packing means.

20. The apparatus of claim 19 wherein said metal reinforcing means is characterized by a metal packer bladder disposed inside said packer element.

21. An inflatable casing packer apparatus for use in a casing string of a well bore, said apparatus comprising:

housing means for connecting to the casing string and defining a central opening therethrough;

inflatable packing means connected to said housing means for sealingly engaging the well bore when inflated, said inflatable packing means comprising:

an elastomeric packer element; and metal reinforcing means for reinforcing said packer element;

inflation passageway means for providing a flow path between said central opening of said housing means and said packing means such that fluid may be pumped into said central opening and directed to said packing means for inflation thereof;

means for opening said inflation passageway means in response to a first differential pressure, thereby allowing inflation of said packing means, said means for opening comprising rupture means for rupturing in response to a predetermined pressure and thereby placing said inflation passageway means in communication with said central opening; and means for closing said inflation passageway means in response to a second predetermined pressure, thereby preventing deflation of said packing means.

22. The apparatus of claim 21 wherein said means for closing comprises pressure actuated valve means for closing in response to said second predetermined pressure and thereby sealingly separating said central opening of said housing means and said packing means.

23. The apparatus of claim 21 wherein said metal reinforcing means is characterized by a metal packer bladder disposed inside said packer element.

* * * * *